United States Patent [19]

Mollenkopf et al.

[11] 4,045,161

[45] Aug. 30, 1977

[54] ROTARY KILN HAVING A PLANETARY ROW OF COOLER TUBES

[75] Inventors: Hans Mollenkopf, Neubeckum; Jurgen Wurr, Ennigerloh; Antonius Vering, Ahlen; Bernhard Loffler, Warendorf; Karl Eiring, Oelde, all of Germany

[73] Assignee: Polysius AG, Neubeckum, Germany

[21] Appl. No.: 632,997

[22] Filed: Nov. 18, 1975

[30] Foreign Application Priority Data

Dec. 13, 1974 Germany ..... 7441586[U]

[51] Int. Cl.[2] ..... F27B 7/38

[52] U.S. Cl. ..... 432/80

[58] Field of Search ..... 432/80, 106, 78, 103, 432/83

[56] References Cited

U.S. PATENT DOCUMENTS

| | | | |
|---|---|---|---|
| 3,384,356 | 5/1968 | Durinck | 432/103 |
| 3,502,139 | 3/1970 | Andersen | 432/80 |
| 3,840,335 | 10/1974 | Deussner | 432/80 |
| 3,840,336 | 10/1974 | Brachthauser | 432/103 |
| 3,859,039 | 1/1975 | Heinemann et al. | 432/106 |

*Primary Examiner*—John J. Camby
*Assistant Examiner*—Henry C. Yuen
*Attorney, Agent, or Firm*—Strauch, Nolan, Neale, Nies & Kurz

[57] ABSTRACT

A rotary kiln having a row of planetary cooler tubes disposed around its outer periphery and carried by individual metal mountings on the kiln casing, adjacent mountings abutting against each other in their areas bordering on the kiln casing and being spaced apart in their areas remote from the kiln casing, for minimizing changing temperature induced stresses imparted therefrom to the kiln casing during operation.

6 Claims, 2 Drawing Figures

ROTARY KILN HAVING A PLANETARY ROW OF COOLER TUBES

This invention relates to a rotary kiln having planetary cooler tubes disposed on its outer periphery and carried by individual mountings provided on the kiln casing.

It is known for all the cooler tube mountings of a section of the kiln casing length to be collected into a single annular mounting member whose outer periphery is then provided with a number of recesses which serve for receiving the individual planetary cooler tubes. During operation of the kiln however, the areas of the individual planetary cooler tubes are often subject to differing thermal elongations, which to some extent lead to considerable stresses in such one-piece mounting members, not infrequently resulting in breakage or other damage to the mounting member.

In order to avoid these difficulties, rotary kiln constructions have therefore been produced wherein the individual mountings for each planetary cooler tube are separately provided on the kiln casing. In this case each two adjacent mountings in the peripheral direction of the kiln casing are separated by an interval which is large enough to allow the adjacent mountings to extend or move independently of each other. However a disadvantage with this known construction is that the mountings and the weight of the planetary cooler tubes they carry cause undesirable stresses (e.g., shearing forces of the like) in the kiln casing while the kiln is being operated.

The invention is thus directed to the problem of providing a rotary kiln of the type reference to initially, wherein while using relatively simple constructional means the individual cooler tube mountings possess adequate freedom in relation to their neighbouring mountings in the peripheral direction of the kiln casing, but at the same time are mounted on the casing in such manner that, especially during kiln operation, the kiln casing is kept free of undesirable stresses, insofar as these can emanate from the mountings.

According to the invention this problem is solved in that adjacent mountings abut against each other in their areas bordering on the kiln casing. With this construction provided by the invention, each planetary cooler tube can also use individual mountings which in the areas spaced outwardly away from the kiln casing have an adequate spacing from their neighbouring mountings in the peripheral direction of the kiln casing, and hence can move or expand in these areas. But since at the same time the peripherally adjacent mountings on the kiln casing have their portions bordering on that kiln casing in contact with each other, there is in practice a continuous annular link extending in the peripheral direction of the kiln casing between all the mountings provided over a longitudinal section of the kiln casing, so that the casing is kept largely free of shear forces and other stresses emanating from the mountings.

According to a preferred embodiment of the invention, the mountings are carried by an annular member which forms an annular section of the kiln casing welded into that casing, and is made from rolled steel section with at least two outwardly projecting webs. This construction has the advantage that the mountings in a longitudinal portion of the kiln casing are carried by a particularly stable member, which in turn is so connected to the kiln casing that no undesirable stresses can be caused between that member and the remainder of the kiln casing. This annular member made from rolled steel section can by suitable design readily be adapted to any form of mounting; its stability can be favourably influenced by the number and size of the profile webs.

One embodiment of the invention is described in more detail below with reference to the drawings. In these:

Figure 1:
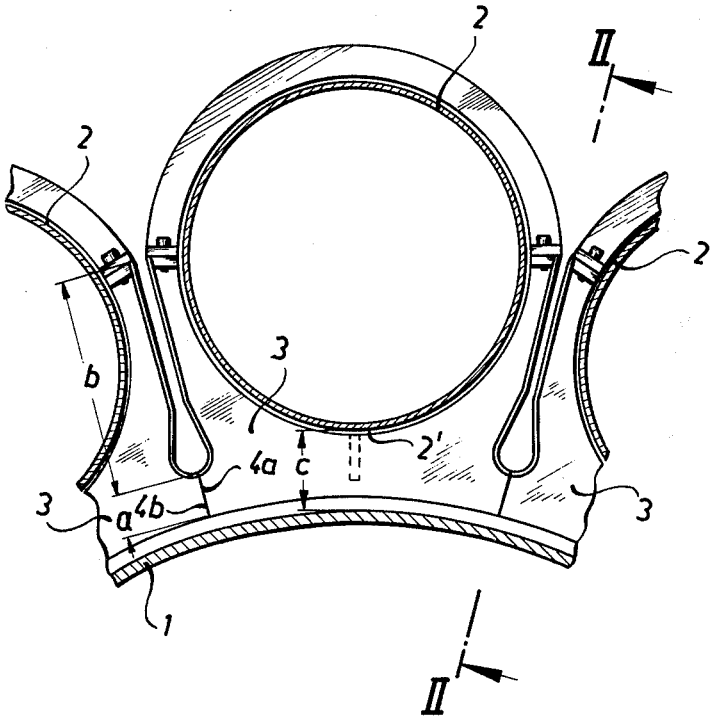
FIG. 1 is a partially cut-away portion of a rotary kiln in accordance with the invention, with the disposition and mounting of a planetary cooler tube.

For simplicity sake, the drawings show only part of the casing 1 of the rotary kiln in accordance with the invention. At the outer periphery of the kiln casing 1 there are provided in usual manner a number of planetary cooler tubes 2 uniformly spaced from each other; the drawing shows only one complete planetary cooler tube 2, while only a small part is shown of the neighbouring cooler tubes in the peripheral direction of the kiln casing. Each cooler tube 2 is carried by a separate mounting 3 secured to the annular peripheral metal wall of the kiln casing 1.

As may clearly be seen from FIG. 1, the mountings 3 adjacent each other in the peripheral direction of the kiln casing have their portions or regions bordering on the kiln casing 1 abutting against each other. In the (larger) remaining portions *b* remote from the kiln casing 1, the mountings 3 are at such a distance (peripherally of the kiln casing) from each other that in these regions *b* they can freely move or extend. The height of the abutting portion *a* between two adjacent mountings 3 is preferably smaller than the distance *c* between the kiln casing 1 and the casing 2' of the planetary cooler tube.

In the embodiment shown, each mounting 3 comprises two metal plates 4, 4' with a gap between them and fixedly held together by webs. These metal plates 4, 4' are parallel to each other and stand upright on the kiln casing 1. In the peripheral direction of the kiln casing these mounting plates 4, 4' are preferably aligned so that the terminal edges (e.g., **4*a* and 4*b* in FIG. 1) of mountings 3 adjacent each other in the peripheral direction abut against each other in the area next to the kiln casing, hence producing the abutments for the neighbouring mountings 3**.

Figure 2:
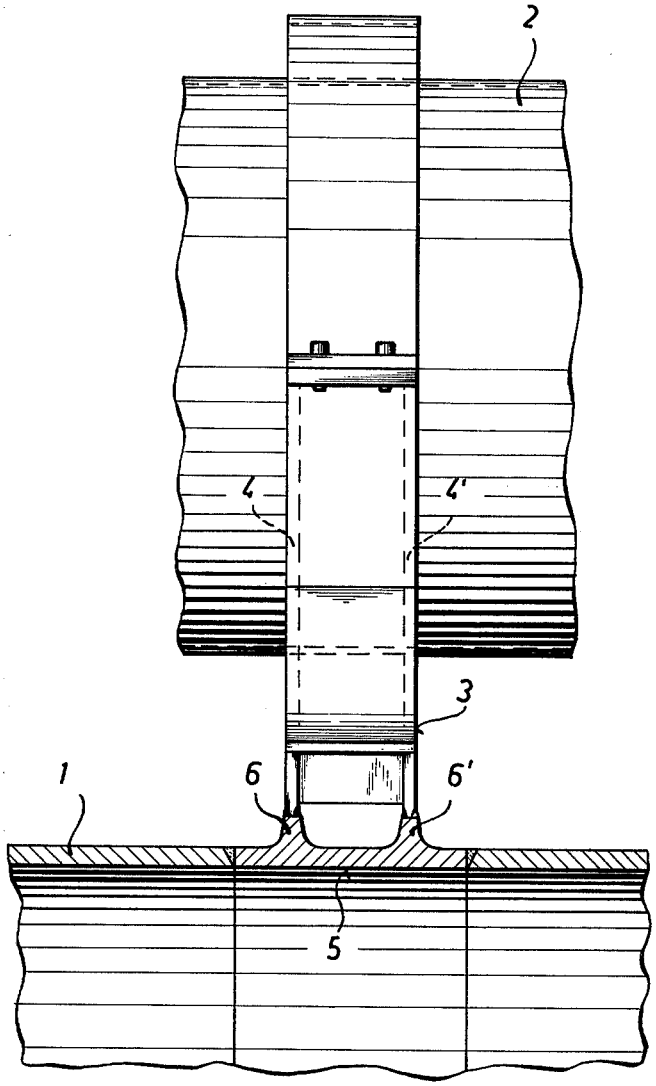
FIG. 2 is a section on the line II—II of FIG. 1.

FIG. 2 shows clearly that the mountings 3 are carried by an annular member 5 which constitutes a longitudinal section of the kiln casing 1 welded into said casing. This annular member 5 is preferably made from rolled steel section and has two outwardly projecting profile webs 6, 6'. These profile webs 6, 6' are spaced from each other longitudinally of the kiln casing 1 at a distance which corresponds to that of the two mounting plates 4, 4' of the mounting 3, so that the edges of said mounting plates 4, 4' which are directed towards the kiln casing 1 can be welded directly on to the outer periphery of the profile webs 6, 6'. The inside of the annular member 5 is of cylindrical form, with a diameter corresponding to the inside diameter of kiln casing 1, so that the annular member 5 forms a transition-free smooth interior with the interior of the remaining kiln casing 1.

While in the embodiment shown, the mounting 3 largely comprises the two metal plates 4, 4', a number of such plates can also naturally be provided to produce a still more stable mounting, or the entire mounting may take the form of a hollow section or a box section. But in each case it is important that only those areas of the mountings which are adjacent the kiln casing abut against each other, while the remaining areas of adjacent mountings are adequately spaced from each other.

A number of variations are also possible for the construction of the annular member carrying the mountings. While with the embodiment shown in FIG. 2 the annular member comprises an integral section with two outwardly projecting profile webs, a number of separate rolled sections can naturally also be put in sequence longitudinally of the kiln casing and bonded together to form the annular member, so that the desired number of profile webs then project annularly from the outer side of the annular member.

This construction of the annular member from steel section in accordance with the invention provides such an effective mode of attachment for the mountings on the kiln casing that support plates or the like such as needed with known constructions can be omitted.

What we claim is:

1. A rotary kiln comprising a casing having an annular peripheral wall, a row of substantially parallel circumferentially spaced cooler tubes disposed around the periphery of said casing, and a plurality of individual heat conductive mounting plate means for said tubes, separately secured to said casing wall, the radially inner region of each individual mounting plate means near the casing being in side edge abutment with the corresponding inner region of each adjacent mounting plate means circumferentially of said casing and outer regions of adjacent mounting plate means located radially outward of said inner regions being spaced from one another in non-heat conducting relation circumferentially of said casing, the abutting radially inner regions of said plurality of said mounting plate means forming a substantially continuous annular link extending peripherally around said casing, and said tubes being disposed radially outwardly of said link.

2. A rotary kiln as defined in claim 1, characterized in that each individual mounting means (3) comprises at least two spaced metal plates (4, 4') fixedly connected together and so aligned around the periphery of the kiln casing (1) that the adjacent circumferentially facing terminal edges **(4*a*, 4*b*) at the inner regions of said mounting means (3)** abut against each other, while in the outer regions remote from the kiln casing they are spaced apart from each other circumferentially.

3. A rotary kiln as defined in claim 2, characterised in that the tube mounting plates are carried by an annular metal section of the kiln casing having at least two outwardly projecting profile webs (6, 6') to which said plates are secured.

4. A rotary kiln as defined in claim 3, characterised in that the mounting plates (4,4') have edges directed towards the kiln casing (1) welded directly to the outer peripheries of said profile webs (6,6').

5. A rotary kiln as defined in claim 1, characterised in that the radial extent of the abutting regions of each two adjacent mounting means (3) from the kiln casing (1) is smaller than the distance (c) between the kiln casing wall and the radially inner most part of a cooler tube (2).

6. A rotary kiln as in claim 3, characterised in that the kiln casing is metal and said annular section of the kiln casing is a welded metal component casing.

* * * * *